US008776413B2

(12) United States Patent
Willett

(10) Patent No.: US 8,776,413 B2
(45) Date of Patent: Jul. 15, 2014

(54) SYSTEMS AND METHODS OF ARTIFICIAL SNOW DISPERSAL

(76) Inventor: Michael Willett, Dacula, GA (US)

( * ) Notice: Subject to any disclaimer, the term of this patent is extended or adjusted under 35 U.S.C. 154(b) by 80 days.

(21) Appl. No.: 13/468,018

(22) Filed: May 9, 2012

(65) Prior Publication Data

US 2012/0286059 A1 Nov. 15, 2012

Related U.S. Application Data

(60) Provisional application No. 61/484,160, filed on May 9, 2011.

(51) Int. Cl.
*G09F 19/00* (2006.01)
*F25C 3/00* (2006.01)
*A63J 5/02* (2006.01)

(52) U.S. Cl.
CPC ... *F25C 3/00* (2013.01); *A63J 5/028* (2013.01)
USPC ..... 40/410

(58) Field of Classification Search
CPC ..... A63J 5/028; F25C 3/00
USPC ..... 239/2.2, 14.2, 211; 40/410
See application file for complete search history.

(56) References Cited

U.S. PATENT DOCUMENTS

| | | | | |
|---|---|---|---|---|
| 3,415,512 | A | 12/1968 | Burnbaum | |
| 4,028,830 | A | 6/1977 | Ottinger | |
| 4,491,273 | A * | 1/1985 | Manhart | 239/14.2 |
| 4,962,922 | A | 10/1990 | Chu | |
| 5,412,888 | A | 5/1995 | Rickuss et al. | |
| 6,129,290 | A * | 10/2000 | Nikkanen | 239/2.2 |
| 6,474,090 | B2 | 11/2002 | Guerra | |
| 6,696,116 | B2 | 2/2004 | Bigman | |
| 6,939,465 | B2 * | 9/2005 | Dupre | 210/248 |
| 2003/0041490 | A1 | 3/2003 | Dott et al. | |
| 2004/0035947 | A1 * | 2/2004 | Ratnik | 239/2.2 |
| 2004/0050949 | A1 * | 3/2004 | Duper | 239/14.2 |
| 2010/0281953 | A1 * | 11/2010 | Jarvie | 73/40.5 R |

* cited by examiner

*Primary Examiner* — Kristina Junge
(74) *Attorney, Agent, or Firm* — Benjamin A. Balser; Balser & Grell IP Law

(57) ABSTRACT

Systems and methods of artificial snow dispersal are disclosed in which rapid evaporating snow is produced from a fluid. Two lines, an air line and a fluid line, are configured to substantially reach the top of or near the top of the tree. The respective lines may be configured to move air and fluid to the top of the tree. At the top of the tree there may be a nozzle with air escape holes configured around the exterior of the component. An output membrane may attach to the middle of the nozzle. The fluid line emits a small amount of fluid into the fabric. The air that passes into the fabric causes small foam bubbles. The air that passes through the external section of the output membrane may then peel the foam bubbles off thereby creating artificial snow.

19 Claims, 8 Drawing Sheets

SYSTEMS AND METHODS OF ARTIFICIAL SNOW DISPERSAL

CROSS-REFERENCE TO RELATED APPLICATION

This application claims benefit to U.S. provisional patent application Ser. No. 61/484,160, filed on May 9, 2011, which is incorporated by reference herein.

TECHNICAL FIELD

The present disclosure is generally related to special effects systems and, more particularly, is related to artificial snow dispersal.

BACKGROUND

Artificial snow is often used outdoors in winter time when real snow is either not plentiful, not available in a desired location, or for any of a plethora of other issues. The artificial snow may be sticky and not suitable for indoor locations, for example. There are heretofore unaddressed needs with previous solutions in artificial snow dispersal.

DETAILED DESCRIPTION

Figure 1:
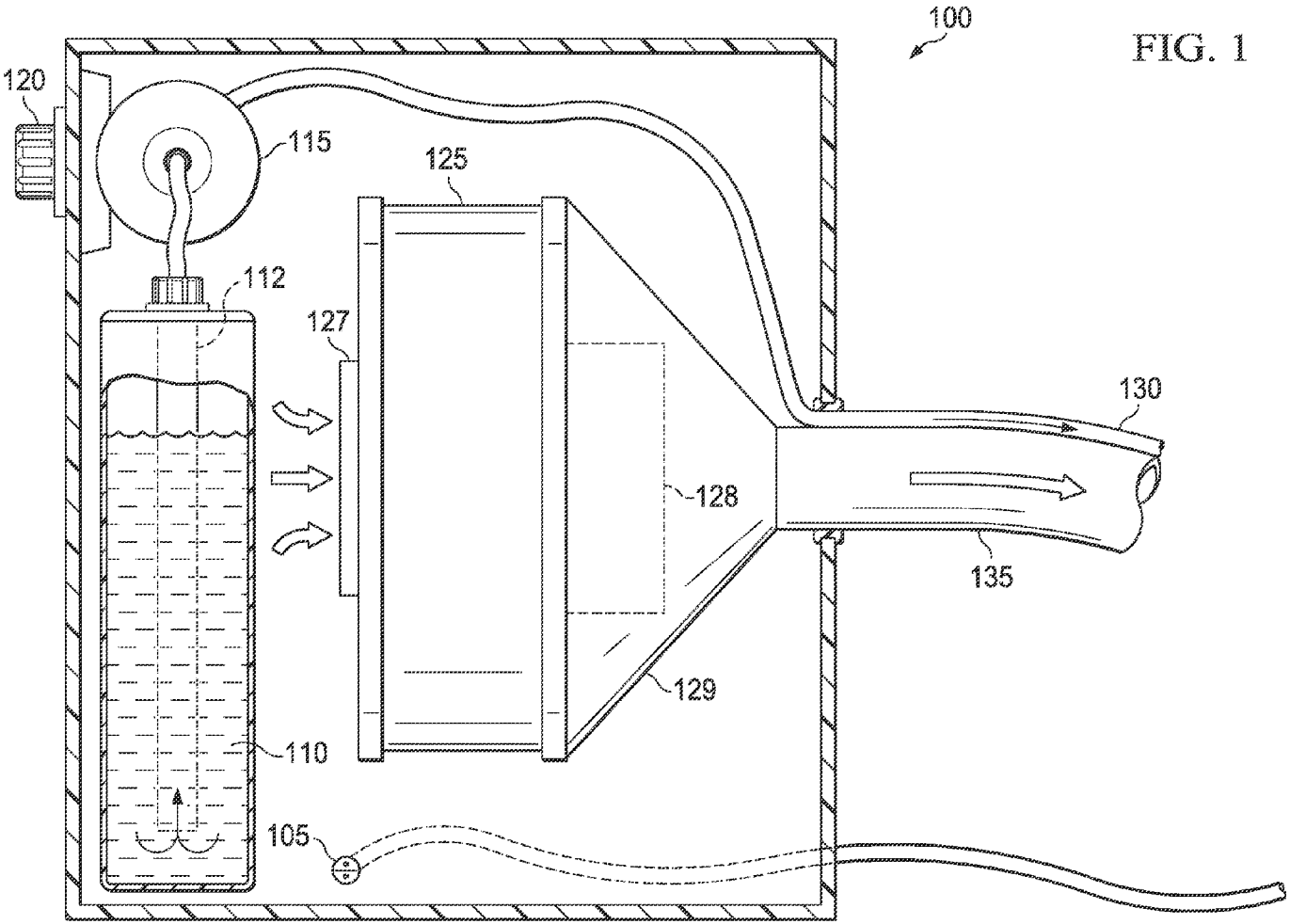
FIG. 1 is a system diagram of an example embodiment of an artificial snow production machine.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

In an example embodiment, artificial snow is produced from a disguised apparatus. In an example embodiment, an artificial snow dispersal system is housed in an artificial Christmas tree. A set of tubes is housed within the center post of the artificial tree and the artificial snow is dispersed from the top of the tree. A snow machine may be located at the bottom of the tree and the material for producing the artificial snow may be pumped to the top of the tree for dispersal. In an example embodiment, the snow machine may be disguised as a gift. An example embodiment may include the system of artificial snow dispersal integrated into the tree. However, alternative embodiments may include retrofitting a real or artificial tree with a system as disclosed herein.

In an example embodiment, an artificial snow dispersal unit may be disguised as a star or an angel that will shoot out the snow. Examples of prior art methods shoot out plastic pellets or solid material, for example, that cascade down the tree and are collected in a satellite dish at the bottom. These examples inject the pellets at the top of the tree. Then the pellets are collected at the bottom and returned to the top of the tree.

In example embodiments of the disclosed systems and methods of artificial snow dispersal, rapid evaporating snow is produced from a fluid. In an example embodiment, two lines, an air line and a fluid line, are configured to substantially reach the top of or near the top of the tree. Alternatively, the lines may have outputs at any point of the tree or other dispersal device. The fluid line may be embedded in the air line. The respective lines may be configured to move air and fluid to the top of the tree. At the top of the tree there may be a nozzle that is, as a non-limiting example, a plastic molded component with air escape holes configured around the exterior of the component. An output membrane (as a non-limiting example, a fabric cone) may attach to the middle of the nozzle. The fluid line may be configured to extend into the fabric cone. In an example embodiment, the fluid line emits a small amount of fluid into the fabric. The air that passes into the fabric causes small foam bubbles. The air that passes through the external section of the output membrane may then peel the foam bubbles off thereby creating artificial snow. In an example embodiment, the artificial snow evaporates almost immediately upon hitting any surface. The amount of fluid may be adjusted to make larger or smaller snowflakes. The nozzle may comprise a hinge or other device (for example, ball and socket) which allows for positioning of the nozzle to allow the nozzle to be angled to shoot the snow away from the tree in a desired direction.

FIG. 1 provides an example embodiment of artificial snow machine 100. Example embodiments of artificial snow machine 100 include switch 105 which may be, as a non-limiting example, a toggle switch that powers pump 115. Flow control dial 120 may control the amount of fluid that pump 115 pulls from fluid reservoir 110 and pushes through line 130. The artificial snow machine can produce a microscopic size snow flake, a dime-sized flake, or blizzard sized snowflakes, among other sizes. The size of the flake may be determined by how much fluid is injected into a fabric nozzle at the end of line 130.

Air may be injected in inlet 127 of blower 125. Motor 128 is cooled by funneling air with cone 129. Motor 128 increases or decreases the air pressure into air line 135. Cone 129 may be sealed to blower 125. Cone 129 may be a solid piece of material. The shape and size of cone 129 may determine the pressure, which may also be related to the length of the hose used to reach the output of line 130. For a retrofitted implementation, different size cones may be used depending on the height of the application. Fluid reservoir 110 may contain fluid which may be, for example, a pre-mix snow material. Fluid line 130 and air line 135 may run side by side out of the box.

Figure 2:
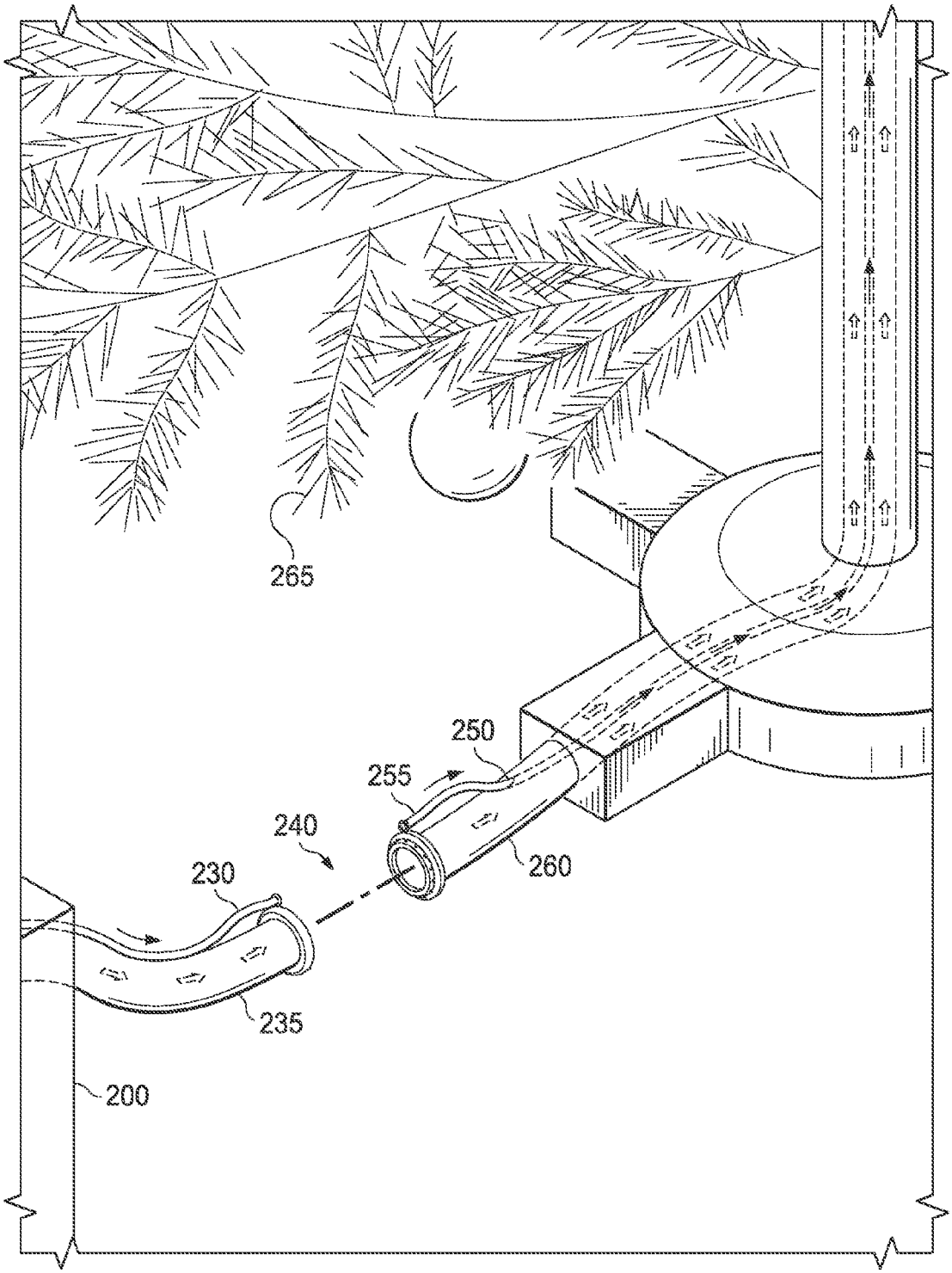
FIG. 2 is a system diagram of an example embodiment of the artificial snow production machine of FIG. 1 connected to an artificial snow dispersal device.

FIG. 2 provides an example embodiment of artificial snow machine 100 of FIG. 1 connected to artificial snow dispersal device 265. In an example embodiment, hoses 230 and 235 extend from box 200 to quick-connect point 240. Each side of fluid line 230, 255 and air line 235, 260 may have quick-connect connections. Fluid line 255 on the tree-side of quick-connect point 240 runs inside air line 260 at point 250. The couplings may be designed such that the lines are sealed upon disconnect. Although artificial snow dispersal device 265 is illustrated as a Christmas tree, artificial snow dispersal device 265 could be a street lamp, palm tree, etc.

Figure 3A:
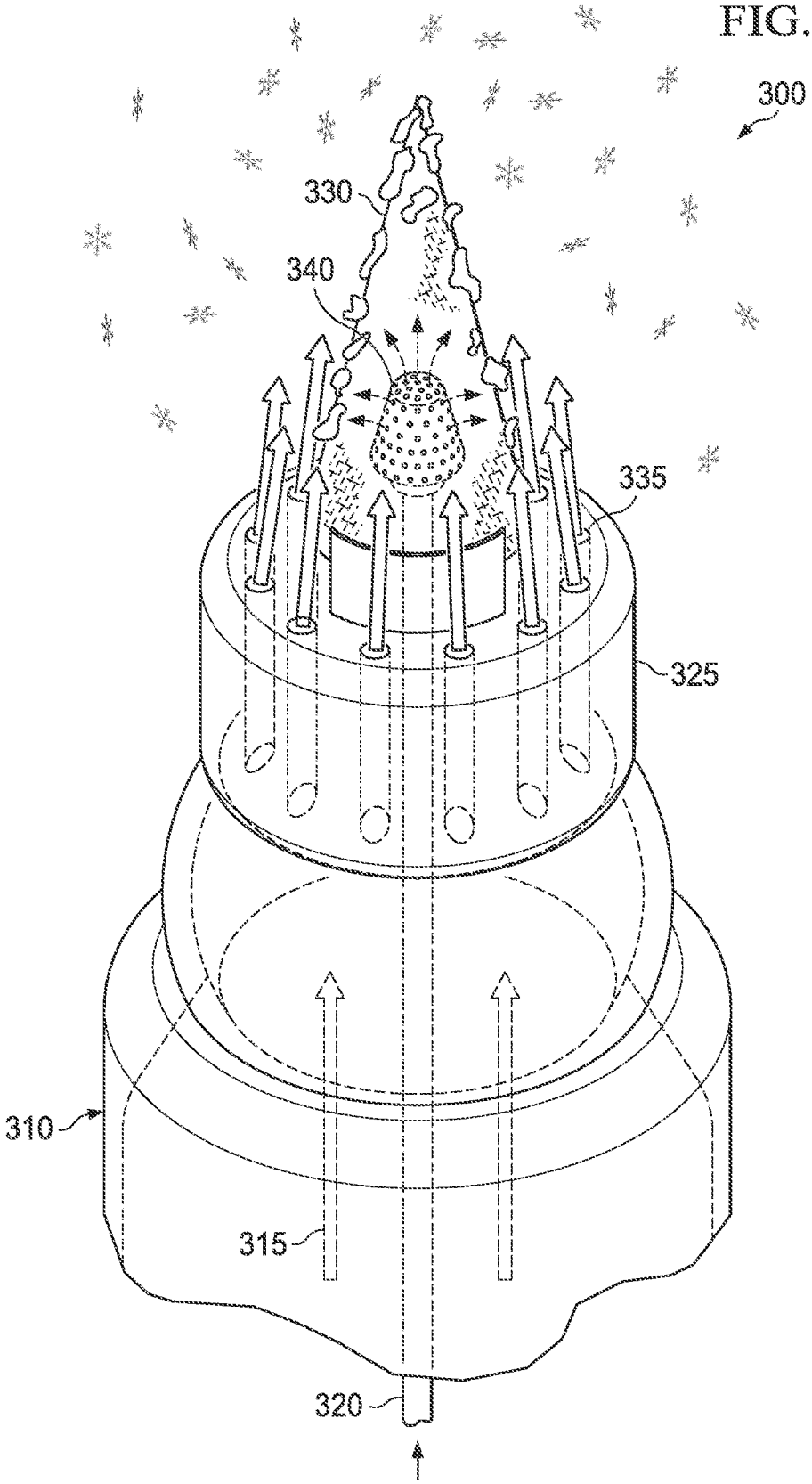
FIG. 3*a* is a system diagram of an example embodiment of the artificial dispersal unit of the artificial snow device of FIG. 2.

FIG. 3*a* provides an example embodiment of artificial dispersal unit 300 at the top of artificial snow dispersal device 265 of FIG. 2. Fluid line 320 runs directly in the center of hose 310 and up to output membrane 330 on the top. Holes 335 are fabricated in output membrane housing 325 and output membrane 330. Output membrane 330 may be made of fabric or other porous material, and different types of material produce different types of flakes. For instance, non-limiting example materials include corduroy and mesh. A smaller size flake is made from a tighter mesh. Output membrane 330 is filled with fluid and the air that is generated through air line 320 causes the bubbles. A smaller opening takes more pressure and makes smaller snowflakes. Larger mesh leads to lower pressure and larger flakes. Blower 125 of FIG. 1 may have multiple speeds. The higher the air speed, the smaller the flakes; the lower the air speed, the larger the flake. Blower 125 may be variable with an infinite number of settings between a maximum and minimum speed. Alternatively, there may be a finite number of fixed settings between a maximum and minimum speed.

Figure 3B:
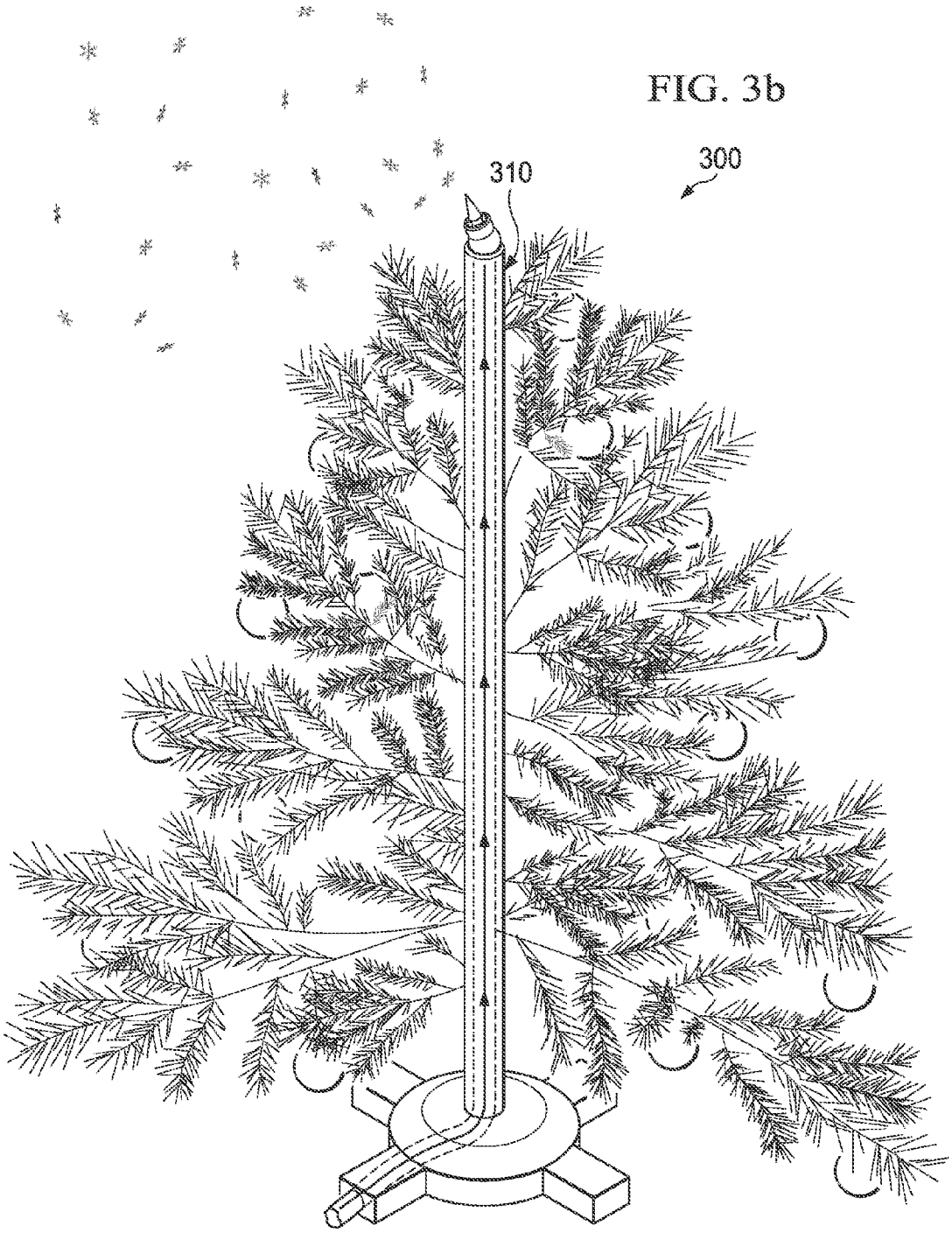
FIG. 3B is a system diagram of an example embodiment of the artificial snow dispersal device of FIG. 2.

In an example embodiment, a plurality of holes 335 are fabricated in solid molded plastic (for example) piece 325. Air flows out of holes 335 and peels the bubbles off of output membrane 330. There may be one or more large holes under the fabric output membrane with smaller surrounding holes for controlling the airflow. Air 315 is forced through the middle hole(s) to produce the bubbles, and the outer holes are used to peel the bubbles off of output membrane 330—to produce the artificial snow. In an example embodiment, the end of fluid line 320 is capped with filter 340 that may be made of a non-limiting material such as brass. Filter 340, similar to a filter in a fish aquarium, may be used to introduce the fluid to fabric output membrane 330. FIG. 3*b* provides a view of artificial tree 300 with an integrated system in center pole 310.

Figure 4:
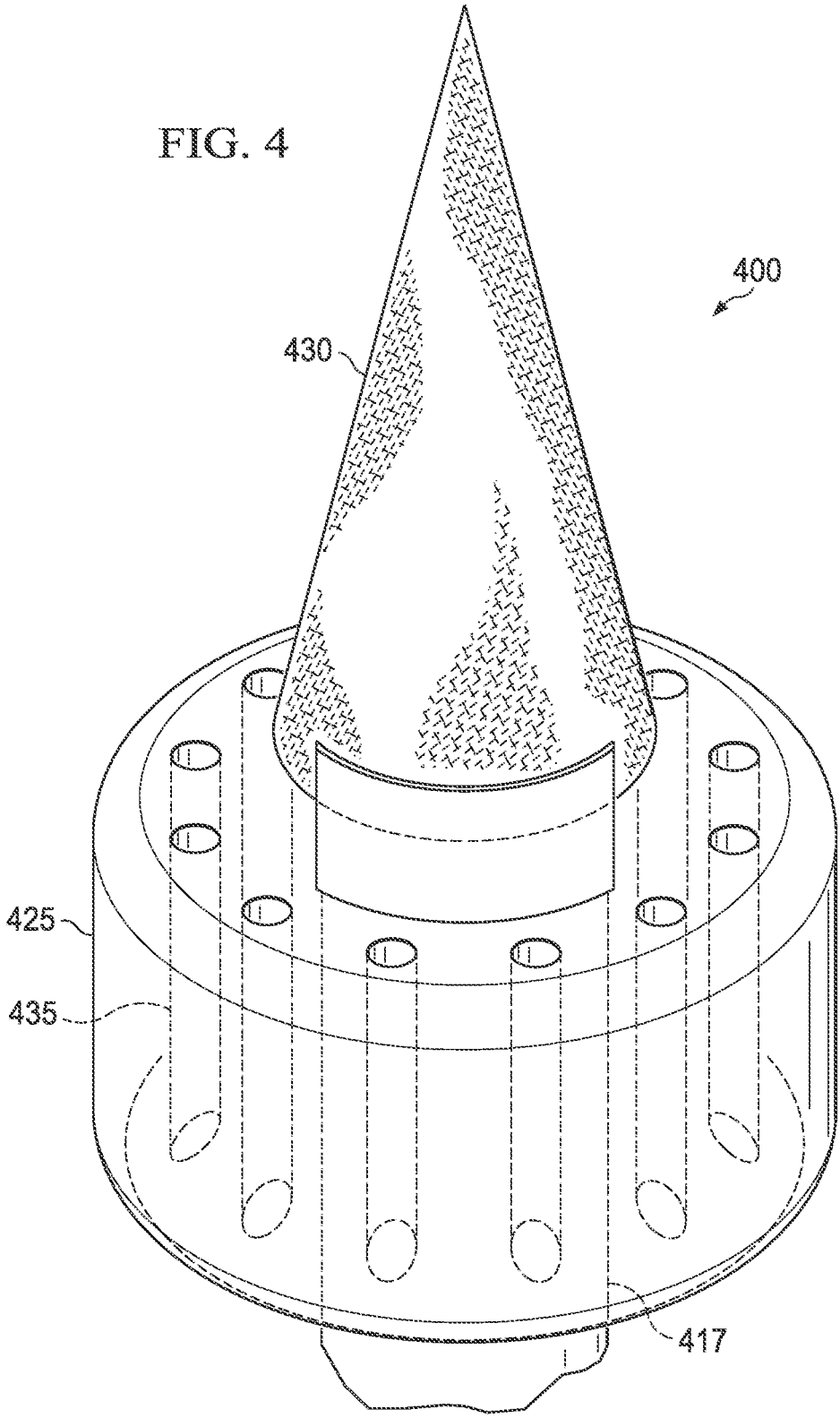
FIG. 4 is a system diagram of an example embodiment of the nozzle of FIG. 3A.

FIG. 4 provides a close up view of nozzle 400 comprising output membrane 430, air line 417, and output membrane housing 425 with a plurality of holes 435. In an example embodiment, a plurality of holes 435 are fabricated in a non-limiting example of solid molded output membrane housing 425. The air flows out of holes 435 and peels the bubbles off of output membrane 430. There may be one or more large holes under the fabric output membrane with smaller surrounding holes for controlling the airflow. Air is forced through the middle hole(s) to produce the bubbles, and outer holes 435 are used to peel the bubbles off of output membrane 430—to produce the artificial snow.

Figure 5:
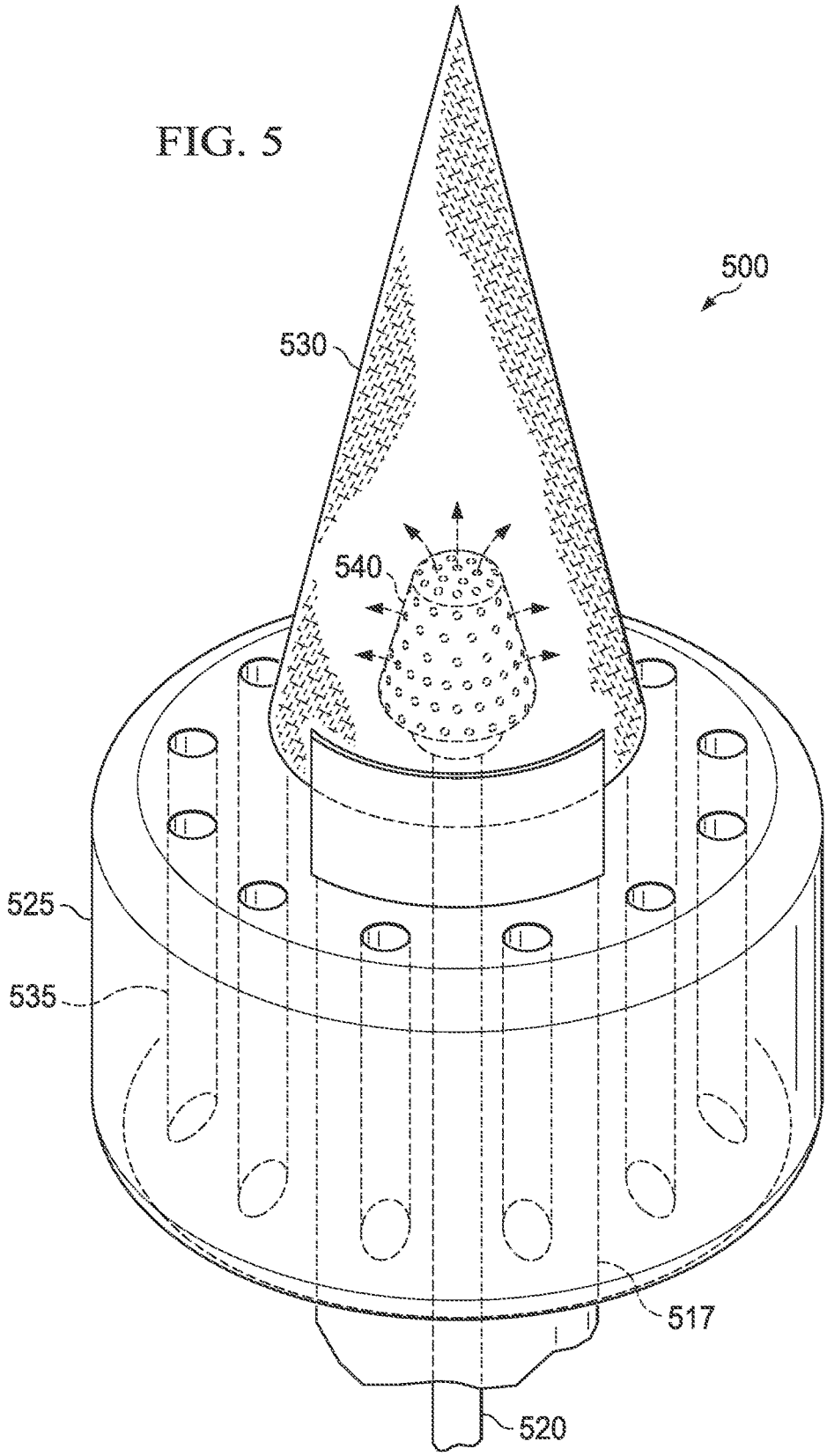
FIG. 5 is a system diagram of an example embodiment of the nozzle of FIG. 3A.

FIG. 5 provides an example embodiment of nozzle 500 with integrated fluid filter 540. This example embodiment of nozzle 500 comprises output membrane 530, filter 540, air line 517, fluid line 520, and output membrane housing 525 with a plurality of holes 535. Fluid line 520 runs directly in the center of air hose 517 and up to output membrane 530 on the top. Holes 535 are fabricated in housing 525 and output membrane 530. Output membrane 530 may be made of fabric or other porous material. Non-limiting example materials include corduroy and mesh. A smaller size flake is made from a tighter mesh. Nozzle 500 is filled with fluid and the air that is generated through air line 520 causes snow bubbles. A smaller opening makes higher pressure and makes smaller snowflakes. Larger mesh leads to lower pressure and larger flakes. The blower may have multiple speeds. The higher the air speed, the smaller the flakes; the lower the air speed, the larger the flake. The fan may be variable with an infinite number of settings between a maximum and minimum speed. Alternatively, there may be a finite number of fixed settings between a maximum and minimum speed.

In an example embodiment, a plurality of holes 535 are fabricated in output membrane housing 525, which may, for example, comprise molded plastic. The air flows out of holes 535 and peels the bubbles off of output membrane 530. There may be one or more large holes under the fabric output membrane with smaller surrounding holes for controlling the airflow. Air 515 is forced through the middle hole(s) to produce the bubbles, and the outer holes are used to peel the bubbles off of the output membrane—to produce the artificial snow. In an example embodiment, the end of fluid line 520 has filter 540 that is made of a non-limiting material such as brass. Filter 540, similar to a filter in a fish aquarium, may be used to introduce the fluid to fabric output membrane 530. In an example embodiment, filter 540 applies the fluid to inner surface of output membrane 530 substantially evenly. Alternatively, filter 540 may be configured to emit the fluid in a pattern on, or in a specific area of output membrane 530. Although output membrane 530 is described as a cone, it may comprise any shape.

Figure 6:
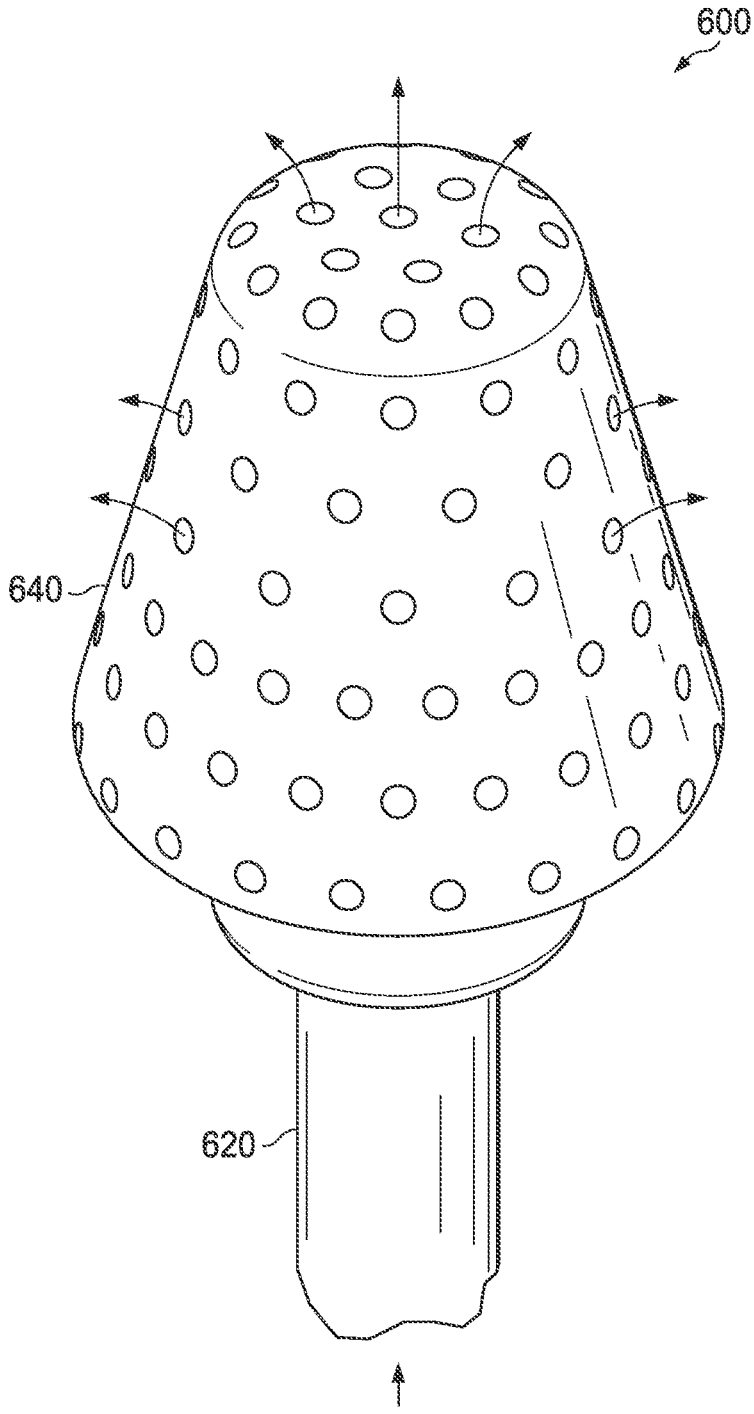
FIG. 6 is a system diagram of an example embodiment of the filter of the nozzle of FIG. 5.

FIG. 6 provides an example embodiment of filter system 600 that comprises filter 640 attached to the upper end of fluid line 620. The fluid from fluid line 620 is emitted from the holes in filter 640. In an example embodiment, filter 640 may emit fluid in substantially all directions to provide coverage on the fabric output membrane.

Figure 7:
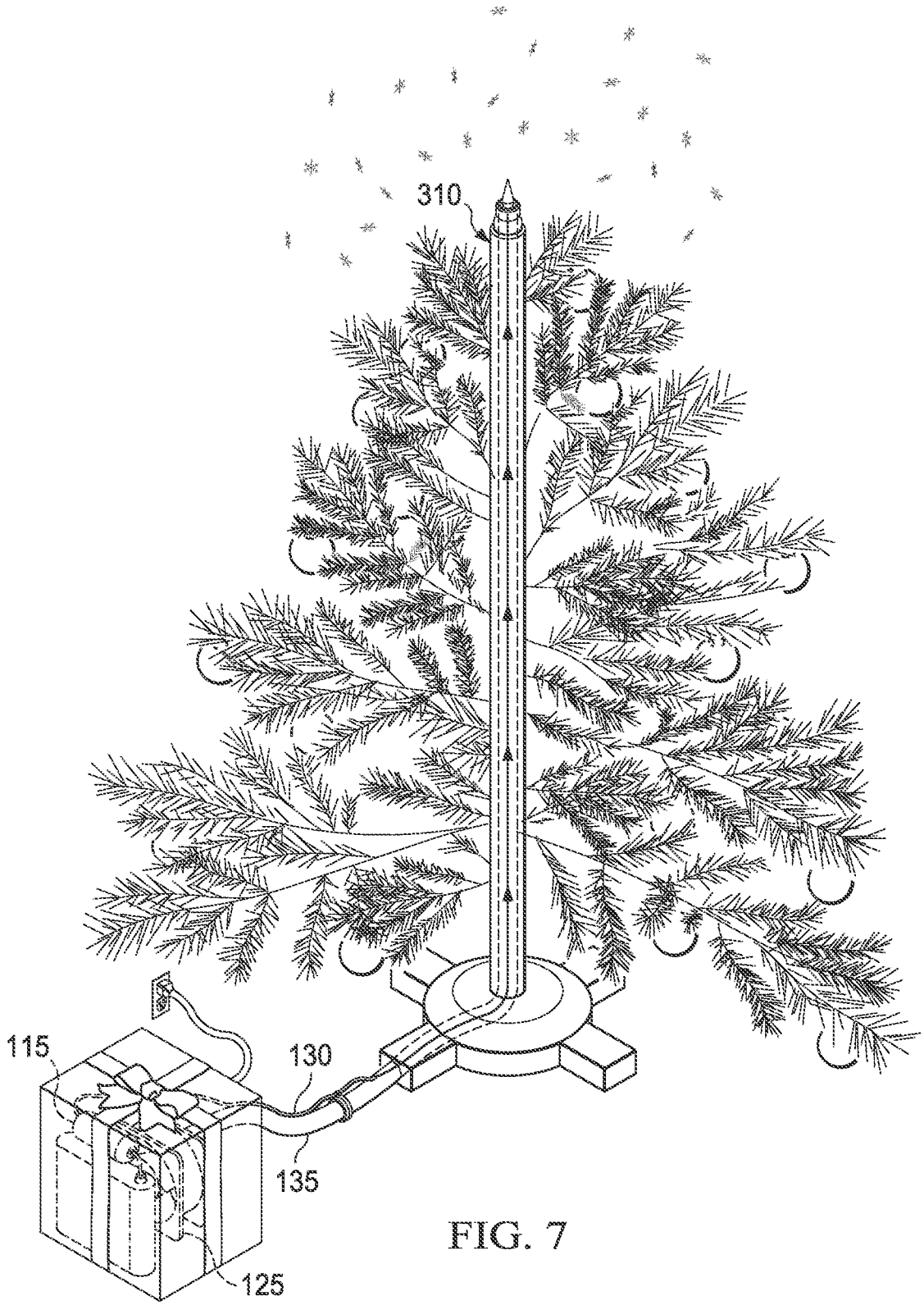
FIG. 7 is a system diagram of an example embodiment of the artificial snow dispersal system.

FIG. 7 provides an view of an example embodiment of the artificial snow dispersal system. Fluid from fluid container 115 is pumped through fluid line 130 through center pole 310 of the artificial tree. Air is forced with blower 125 through air line 135 through center pole 310 of the artificial tree. As previously described, the artificial snow is produced from the nozzle at the top of center pole 310.

Although the present disclosure has been described in detail, it should be understood that various changes, substitutions and alterations can be made thereto without departing from the spirit and scope of the disclosure.

Therefore, at least the following is claimed:

1. A system comprising:

an artificial snow production machine configured to produce artificial snow that substantially evaporates upon contact;

an artificial snow dispersal device connected to the artificial snow production machine, the artificial snow dispersal device comprising:

a fluid line;

an air line;

a permeable output membrane, wherein the artificial snow dispersal device receives air and fluid from the air and fluid lines and outputs the fluid through the permeable output membrane to form artificial snow; and a dispersing filter at an end of the fluid line, the dispersing filter comprising a plurality of holes in multiple substantially lateral and longitudinal directions to emit the fluid onto the permeable output membrane;

wherein air from the air line removes the artificial snow from the output membrane.

2. The system of claim 1, wherein the artificial snow dispersal device comprises at least one of a Christmas Tree, a lamp post, a street lamp, and a palm tree.

3. The system of claim 1, wherein, the artificial snow production machine further comprises a housing, the housing comprising a gift box.

4. The system of claim 1, wherein the artificial snow dispersal device comprises:

the filter configured in an inner space of the output membrane;

a fluid line configured to supply the fluid through the filter; and an air line configured to supply the air to remove the artificial snow from the output membrane.

5. The system of claim 4, wherein the filter comprises a brass filter.

6. The system of claim 5, further comprising a output membrane housing.

7. The system of claim 6, wherein the output membrane housing is molded plastic.

8. The system of claim 1, wherein the system is retrofitted on an existing structure.

9. A method, comprising:

providing a fluid line and an air line to a structure;

providing fluid through the fluid line through a dispersing filter and a permeable membrane to form artificial snow on an outer surface of the permeable membrane, the dispersing filter providing the fluid to the membrane through a plurality of holes in multiple substantially lateral and longitudinal directions;

providing air through the air line to remove the artificial snow from the outer surface of the permeable membrane.

10. The method of claim 9, wherein the structure is an artificial Christmas tree.

11. The method of claim 9, wherein the permeable membrane is a mesh with holes configured to emit a particular sized snowflake.

12. The method of claim 9, further comprising regulating the fluid flow to regulate the size of a snowflake.

13. The method of claim 9, further comprising regulating the air flow to regulate the size of a snowflake.

14. A device comprising:

an output membrane housing configured:

to receive an air line and a fluid line, and comprising a plurality of holes;

to attach to a structure and a permeable output membrane;

to provide fluid to an inner surface of the permeable output membrane through a dispersing filter with a plurality of holes for dispersing the fluid in multiple substantially lateral and longitudinal directions to form artificial snow on an outer surface of the permeable output membrane; and to provide air to the outer surface of the permeable output membrane through the plurality of holes to remove the artificial snow from the outer surface of the permeable output membrane.

15. The device of claim 14, wherein the output membrane housing comprises molded plastic.

16. The device of claim 14, wherein the filter is configured to apply the fluid to the inner surface of the permeable output membrane substantially evenly.

17. The device of claim 14, wherein the structure is a Christmas tree.

18. The device of claim 14, wherein the device is integrated into the structure.

19. The device of claim 14, wherein the device is an add-on to an existing structure.

* * * * *